US009027854B2

(12) United States Patent
Moser et al.

(10) Patent No.: US 9,027,854 B2
(45) Date of Patent: May 12, 2015

(54) SWIRL NOZZLE

(75) Inventors: Achim Moser, Sulzbach (DE); Klaus Kadel, Witten (DE)

(73) Assignee: Boehringer Ingelheim International GmbH, Ingelheim (DE)

( * ) Notice: Subject to any disclaimer, the term of this patent is extended or adjusted under 35 U.S.C. 154(b) by 1501 days.

(21) Appl. No.: 11/682,604

(22) Filed: Mar. 6, 2007

(65) Prior Publication Data

US 2007/0215723 A1 Sep. 20, 2007

(30) Foreign Application Priority Data

Mar. 7, 2006 (DE) ..... 10 2006 010 877
Nov. 23, 2006 (DE) ..... 10 2006 055 661

(51) Int. Cl.
*B05B 1/34* (2006.01)
*B05B 15/00* (2006.01)

(52) U.S. Cl.
CPC ..... *B05B 1/3436* (2013.01); *B05B 15/008* (2013.01)

(58) Field of Classification Search
CPC .. B05B 1/3436; B05B 15/008; B05B 1/3405; B05B 1/341
USPC ..... 239/399, 403, 462, 463, 466–470, 474, 239/475, 487, 489, 494, 590, 461
See application file for complete search history.

(56) References Cited

U.S. PATENT DOCUMENTS 2,321,428 A * 6/1943 Schloz ..... 239/466
2,974,880 A * 3/1961 Stewart et al. ..... 239/493
4,036,439 A * 7/1977 Green ..... 239/466
4,467,965 A 8/1984 Skinner
5,067,655 A * 11/1991 Farago et al. ..... 239/124
5,435,884 A 7/1995 Simmons et al.
5,722,598 A * 3/1998 Werding ..... 239/403
5,740,967 A 4/1998 Simmons et al.
5,951,882 A 9/1999 Simmons et al.
6,171,972 B1 1/2001 Mehregany et al.

(Continued)

FOREIGN PATENT DOCUMENTS

DE 931 074 8/1955
EP 412524 A1 * 2/1991

(Continued)

OTHER PUBLICATIONS

International Search Report of International Application No. PCT/EP2007/001558 Dated Sep. 28, 2007.

*Primary Examiner* — Jason Boeckmann
(74) *Attorney, Agent, or Firm* — Roberts Mlotkowski; Safran & Cole, P.C.; David S. Safran

(57) ABSTRACT

A simple, compact construction and easy manufacture of a swirl nozzle having a plurality of inlet channels and an outlet channel extending transversely thereto are made possible by the fact that the inlet channels open directly and/or tangentially into the outlet channel. Alternatively or additionally, upstream of the inlet channels is provided a filter structure having smaller flow cross-sections than the inlet channels. The swirl nozzle is used, in particular, for atomizing a liquid medicament formulation. The swirl nozzle is produced from two plate-shaped components, the outlet channel first being etched as a blind bore in one component and then opened up by grinding the component away. Alternatively or additionally, the outlet channel is formed in a different component from the inlet channels.

22 Claims, 5 Drawing Sheets

(56) References Cited

U.S. PATENT DOCUMENTS

| | | | | |
|---|---|---|---|---|
| 6,186,409 | B1 | 2/2001 | Srinath et al. | |
| 6,199,766 | B1 | 3/2001 | Fox et al. | |
| 6,457,658 | B2 | 10/2002 | Srinath et al. | |
| 7,066,408 | B2 | 6/2006 | Sugimoto et al. | |
| 2002/0060255 | A1* | 5/2002 | Benoist | 239/337 |
| 2006/0086828 | A1* | 4/2006 | Bougamont et al. | 239/468 |

FOREIGN PATENT DOCUMENTS

| | | | |
|---|---|---|---|
| EP | 0 860 210 | A2 | 8/1998 |
| EP | 0768921 | B1 | 10/1999 |
| EP | 0970751 | B1 | 11/2003 |
| FR | 2 756 502 | A1 | 6/1998 |
| WO | 02/070141 | A1 | 9/2002 |

* cited by examiner

SWIRL NOZZLE

BACKGROUND OF THE INVENTION

1. Field of the Invention

The present invention relates to a swirl nozzle, particularly for delivering or atomizing a liquid, preferably a medicament formulation or other fluid, having inlet channels and an outlet channel, the inlet channels extending transversely to the outlet channel, to a method of using the swirl nozzle for atomizing a liquid medicament formulation, and to methods of producing a swirl nozzle and an atomizer comprising a swirl nozzle.

2. Description of Related Art

When atomizing a liquid medicament formulation, the intention is to convert as precisely defined an amount of active substance as possible into an aerosol for inhalation. The aerosol should be characterised by a low mean value for the droplet size, while having a narrow droplet size distribution and a low pulse (low propagation rate).

The term "medicament formulation" according to the present invention extends beyond medicaments to include therapeutic agents or the like, particularly every kind of agent for inhalation or other use. However, the present invention is not restricted to the atomizing of agents for inhalation but may also be used, in particular, for cosmetic agents, agents for body or beauty care, agents for household use, such as air fresheners, polishes or the like, cleaning agents or agents for other purposes, particularly for delivering small amounts, although the description that follows is primarily directed to the preferred atomization of a medicament formulation for inhalation.

The term "liquid" is to be understood in a broad sense and includes, in particular, dispersions, suspensions, so-called solutions (mixtures of solutions and suspensions) or the like. The present invention can also be generally used for other fluids. However, the description that follows is directed primarily to the delivery of liquid.

By the term "aerosol" is meant, according to the present invention, a preferably cloud-like accumulation of a plurality of drops of the atomized liquid with preferably substantially undirected or wide spatial distribution of the directions of movement and preferably with drops traveling at low speeds, but it may also be, for example, a conical cloud of droplets with a primary direction corresponding to the main exit direction or exit pulse direction.

U.S. Pat. Nos. 5,435,884, and 5,951,882 and European Patent EP 0 970 751 B1 are directed to the manufacture of nozzles for vortex chambers. A flat, key-shaped vortex chamber is etched into a plate-shaped piece of material, or component, together with inlet channels opening tangentially into the vortex chamber, starting from a flat side. In addition, an outlet channel is etched through the thin base of the vortex chamber in the centre thereof. The inlet channels are connected at the inlet end to an annular supply channel which is also etched into the component. The component with this etched structure is covered by an inlet piece and installed in a carrier. These vortex chamber nozzles are not ideal for higher pressures and for delivering small amounts or for producing very fine droplets.

SUMMARY OF THE INVENTION

The objective of the present invention is to provide a swirl nozzle, a use of a swirl nozzle and methods of producing swirl nozzles and an atomizer, so as to enable simple nozzle construction and/or ease of manufacture, while still allowing very small amounts of liquid to be delivered and/or very fine atomizing to be achieved, in particular.

This objective is achieved as described below.

According to a first aspect of the present invention, the inlet channels open directly and/or tangentially or at an angle between tangentially and radially into the outlet channel. The vortex chamber used in the prior art is not required. This makes the construction particularly compact and simple. In addition, it allows a more robust structure which will withstand higher pressures, in particular, as there is no longer any need for a vortex chamber with a base which is thin so as to ensure a short length of outlet channel. Instead, it is possible to improve the reinforcement of the material and the support around the outlet channel.

By dispensing with a vortex chamber, the volume of liquid to be received by the nozzle is reduced substantially. This is advantageous, for example, when delivering medicament formulations if very small amounts have to be metered very accurately. Moreover, the smallest possible volumes in the swirl nozzle are advantageous, for example, in order to counteract possible bacterial growth in the medicament formulation in the swirl nozzle and/or contamination of the swirl nozzle caused by the precipitation of solids.

In order to atomize a liquid medicament formulation, the medicament formulation is passed through the proposed swirl nozzle under high pressure, so that the medicament formulation is atomized into an aerosol or a fine spray mist, more particularly immediately on leaving the outlet channel. The resultant cloud is released in a substantially conical shape, in particular.

According to another aspect of the present invention which can be implemented separately, the spray nozzle comprises, upstream of the inlet channels, a filter structure having smaller cross-sections of passage than the inlet channels. This again allows a very small and in particular microfine construction of the swirl nozzle and permits very fine atomization even with small amounts of liquid, as any particles contained in the liquid which is to be atomized and which would otherwise be liable to block the inlet channels or even the outlet channel can be filtered out. Accordingly, high operational reliability is achieved even with a swirl nozzle of very small dimensions.

A first proposed method of producing a swirl nozzle is characterised in that at least one inlet channel is formed on a flat side of a first plate-shaped component and an outlet channel is formed which extends into the component and is initially still closed off at one end. Then, the first component is connected to a second, preferably also plate-shaped component, so that the second component at least partially covers the flat side of the first channel section containing the inlet channel. Only when the two pieces of material have been joined together is the first component machined, particularly ground away on the flat side remote from the second component, thereby opening up the outlet channel on this side. The second component stabilizes the first component during the machining and thereafter. This provides a simple manner of producing relatively thin or small structures, particularly a short outlet channel, with high stability, while also obtaining a swirl nozzle which is resistant to high fluid pressures or other stresses.

A second proposed method of producing a swirl nozzle is characterised in that at least one inlet channel is formed in a first, preferably plate-shaped component starting from a flat side, in that the outlet channel is at least partially formed in a second, preferably plate-shaped component, starting from a flat side and in particular extending transversely thereof, and the two pieces of material are joined together, so that the second component at least partially covers the flat side of the first component comprising the inlet channel. This provides a simple way of manufacturing even very fine structures. The manufacture of the at least one inlet channel and of the outlet channel independently of one another makes it possible to optimize the manufacturing processes involved.

According to a preferred further feature, the outlet channel is formed, particularly by etching, on only one side of the second component, while open, before the pieces of material are joined together. Then, the two pieces of material are joined together for the first time so that the opening of the outlet channel faces towards the first component. Only then is the second component machined, particularly ground away, on the flat side remote from the component, thereby opening up the outlet channel on this side. The first component may accordingly stabilize the second component even during the machining and thereafter.

Further aspects, features, properties and advantages of the present invention will become apparent from the following description of preferred embodiments with reference to the accompanying drawings.

DETAILED DESCRIPTION OF THE INVENTION

Figure 1:
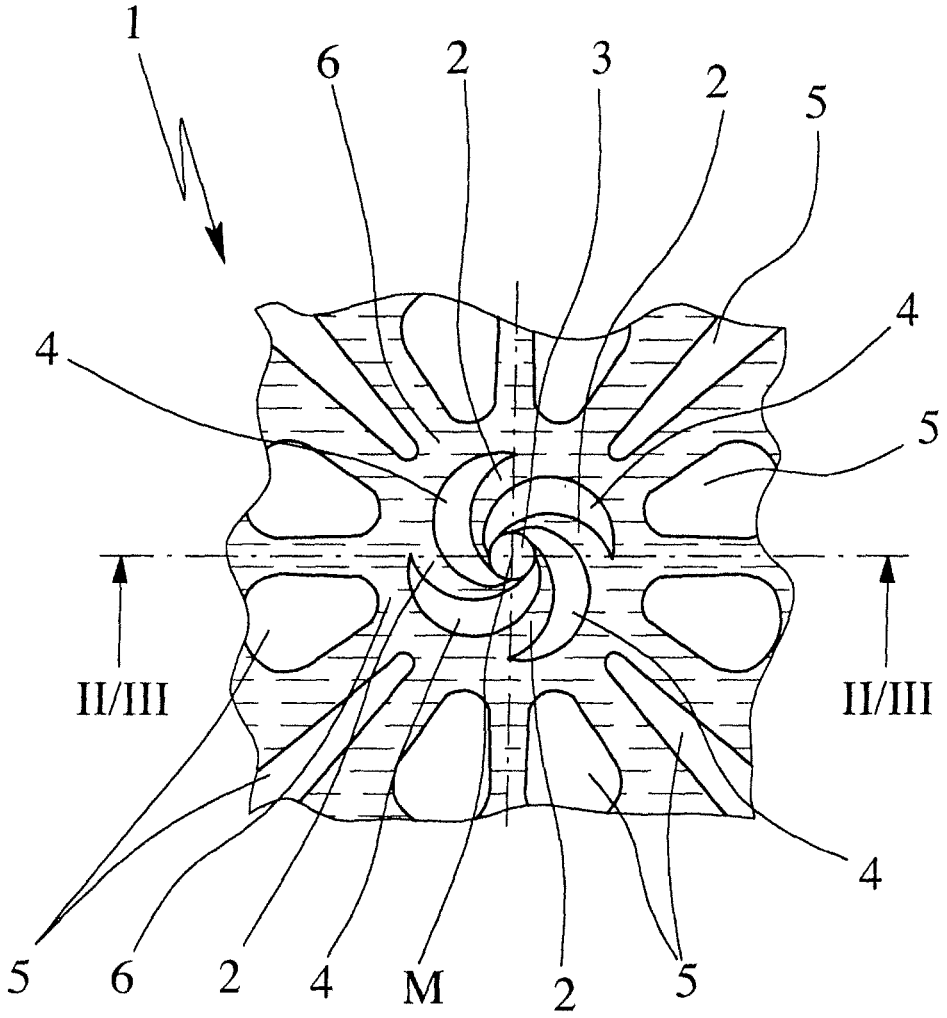
FIG. 1 is a schematic view of a proposed swirl nozzle according to a first embodiment of the invention.

In the figures, the same reference numerals have been used for identical or similar parts, even though the corresponding description may be omitted.

FIG. 1 is a schematic plan view of a proposed swirl nozzle 1 according to a first embodiment, without a cover. The swirl nozzle 1 has at least one inlet channel 2, preferably several and in particular two to twelve inlet channels 2. In the embodiment shown, four inlet channels 2 are provided.

The swirl nozzle 1 also has an outlet channel 3 which in FIG. 1 extends transversely—i.e., at least at an angle and especially perpendicularly—to the plane of the drawing. The inlet channels 2 extend in the plane of the drawing in the embodiment shown, thus in a common plane, in particular. Accordingly, the outlet channel 3 extends transversely (at an angle or slope), especially perpendicularly, to the inlet channels 2 or vice versa. The inlet channels 2 may also extend over a different surface, e.g., a conic surface.

It is proposed that the inlet channels 2 preferably open directly, radially and/or tangentially into the outlet channel 3, but the inlet channels 2 may also open into the outlet channel 3 at an angle between tangentially and radially, preferably more tangentially, particularly preferably in an angular range of 25° starting from the tangential. Thus, in particular, no (additional) vortex chamber is provided as is conventional in the prior art. This allows the structure of the swirl nozzle 1 to be kept simple, compact and particularly robust, as will become apparent from the description to follow. The swirl nozzle 1 may also have further structures upstream of the inlet channels 2; these therefore do not have to form an external inlet for the swirl nozzle 1 but are simply supply lines to the outlet channel 3.

The swirl nozzle 1 serves to deliver and, in particular, atomize a fluid, such as a liquid (not shown), particularly, a medicament formulation or the like. With the structure or arrangement shown in FIG. 1 suitably covered, the liquid is preferably supplied exclusively through the inlet channels 2 to the outlet channel, so that a vortex or turbulence is formed directly in the outlet channel 3. The liquid is preferably expelled only through the outlet channel 3—in particular, without any subsequent lines, channels or the like—and is atomized at this time or immediately afterwards into an aerosol (not shown) or fine droplets or particles.

The inlets of the inlet channels 2 are preferably at a spacing of preferably 50 to 300 μm, especially 90 to 120 μm, from the central axis M of the outlet channel 3. In particular, the inlets are uniformly arranged in a circle around the outlet channel 3 or its central axis M.

The inlet channels 2 extend towards the outlet channel 3 essentially in a radial or curved configuration, preferably with a curvature that is constant or that increases continuously towards the outlet channel 3, and/or with a decreasing channel cross-section. The direction of curvature of the inlet channels 2 corresponds to the direction of swirl of the swirl nozzle 1 or of the liquid (not shown) in the outlet channel 3.

Particularly preferably, the inlet channels 2 are curved at least substantially according to the following formula, which gives the shape of the sidewalls of the inlet channels 2 in polar coordinates (r=radius, W=angle):

$$r = R_E\left(\frac{R_A}{R_E}\right)^{\frac{W-W_E}{W_A-W_E}},$$

wherein $R_A$ is the outlet radius and $R_E$ is the inlet radius of the inlet channel 2 and $W_A$ and $W_E$ are the corresponding angles.

The inlet channels 2 preferably all become narrower toward the outlet channel 3, in particular, by at least a factor based on the cross-sectional area through which fluid can flow.

The inlet channels 2 are preferably formed as depressions, particularly between guide means, partition walls, elevated sections 4 or the like. In the embodiment shown, the inlet channels 2 or the elevated sections 4 which form or define them are at least substantially crescent-shaped or half moon-shaped.

The depth of the inlet channels 2 is preferably 5 to 35 μm in each case. The outlets of the inlet channels 2 preferably each have a width of from 2 to 30 μm, particularly 10 to 20 μm.

The outlets of the inlet channels 2 are preferably each at a spacing from the central axis M of the outlet channel 3 which corresponds to 1.1 to 1.5 times the diameter of the outlet channel 3 and/or at least 1 μm. It can be inferred from the schematic sections shown in FIGS. 2 & 3 that the outlet channel 3 may be somewhat enlarged in cross-section or diameter in its inlet region which is radially bounded or formed by the outlets of the inlet channels 2 or end regions of the elevated sections 4. This enlargement is primarily caused by the manufacturing technique and is preferably small enough not to be hydraulically relevant. This possible radial offset is thus insignificant and the inlet channels 2 still open directly into the outlet channel 3. The enlargement of the diameter is preferably at most 30 μm, particularly only 10 μm or less. The transition from the enlargement to the remainder of the outlet channel 3 may be stepped or possibly conical.

The outlet channel 3 is preferably at least substantially cylindrical. This is true in particular of the above-mentioned inlet region as well. The outlet channel 3 preferably has an at least substantially constant cross-section. The entire (slight) enlargement in the inlet region is not regarded as essential in this sense. However, it is also possible for the outlet channel 3 to have a slight conicity over its length and/or in the inlet region or outlet region, caused particularly by the manufacturing method.

The diameter of the outlet channel 3 is preferably 5 to 100 μm, in particular 25 to 45 μm. The length of the outlet channel 3 is preferably 10 to 100 μm, particularly 25 to 45 μm, and/or preferably corresponds to 0.5 to 2 times the diameter of the outlet channel 3.

The swirl nozzle 1 preferably comprises, upstream of the inlet channels 2, a filter structure which in the embodiment shown is formed by elevated sections 5, and in particular. comprises passage cross-sections that are smaller than the inlet channels 2. The filter structure, which is shown not to scale in FIG. 1, prevents particles from entering the inlet channels 2, which could block the inlet channels 2 and/or the outlet channel 3. Such particles are filtered out by the filter structure because of the smaller passage cross-sections. The filter structure may also be formed independently of the preferred construction of the swirl nozzle 1 as described hereinbefore in other swirl nozzles.

With regard to the filter structure, it is pointed out that it has a plurality of parallel flow channels with the smaller cross-section, and therefore, preferably, substantially more flow paths than inlet channels 2 are provided, with the result that the flow resistance of the filter structure is preferably less than the flow resistance of the parallel inlet channels 2. This also ensures satisfactory operation even when individual flow paths of the filter structure are blocked by particles, for example.

The inlet channels 2 are attached at the inlet end to a common supply channel 6 which serves to distribute and supply the liquid which is to be atomized. In the embodiment shown, the supply channel 6 is preferably annular (cf. FIG. 1) and peripherally surrounds the inlet channels 2. In particular, the supply channel 6 is arranged radially between the filter structure or the elevated sections 5, on the one hand, and the inlet channels 2 or elevated sections 4, on the other hand. The supply channel 6 ensures, in particular, that all the inlet channels 2 are adequately supplied with the liquid which is to be atomized, for example, even when the liquid is supplied only from one side, as shown in FIG. 1, or if the filter structure is partly blocked.

The preferred production of the proposed swirl nozzle 1 described above will now be explained in more detail. However, the manufacturing methods described may theoretically also be used with other swirl nozzles, possibly even ones provided with a vortex chamber.

The inlet channels 2 and the outlet channel 3—preferably also the common supply channel 6 and/or the filter structure—are preferably formed in a one-piece or multipart nozzle body 7. Two proposed methods and embodiments are described more fully hereinafter.

The nozzle body 7 is made in two parts in the first embodiment. It comprises a first, preferably plate-like component 8 and a second, preferably also plate-like component 9.

Figure 2:
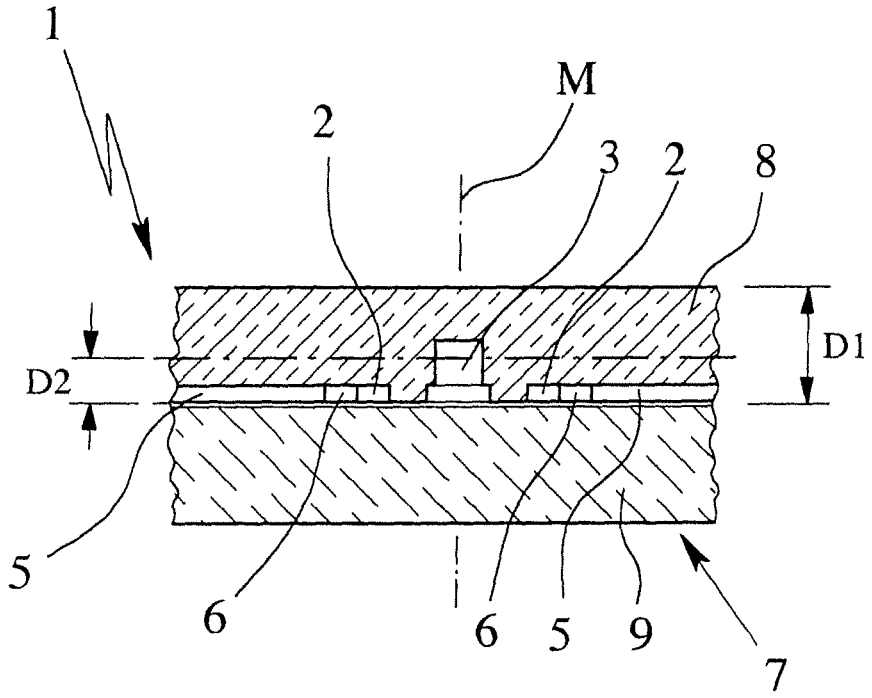
FIG. 2 is a schematic section through the swirl nozzle taken along line II-II in FIG. 1.

FIG. 1 shows only the first component 8, i.e., the swirl nozzle 1 without the second component 9 which forms a cover. FIG. 2 shows, in schematic section taken along the line II-II of FIG. 1, both components 8, 9 of the swirl nozzle 1 in the not yet completely finished state.

In the first embodiment, first of all, the desired structures are formed at least partly and, in particular, at least substantially completely in the first component 8 starting from a flat side, particularly by etching, as described, for example, in the prior art mentioned hereinbefore. In particular, at least one inlet channel 2 and preferably all of the inlet channels 2 and the outlet channel 3 are recessed in the first component 8, starting from the flat side, and more particularly, are formed as depressions by etching. The inlet channels 2 extend parallel to the flat side in particular. The outlet channel 3 extends at right angles to the flat side and is initially recessed or formed only as a recess closed at one end (blind bore).

In addition, all the other desired structures or the like can be simultaneously formed in the first component 8, especially the common supply channel 6, the filter structure and/or other feed lines or the like.

The first component 8 preferably is made of silicon or some other suitable material.

Then, the first component 8 is joined to the second component 9, so that the second component 9 at least partially covers the flat side of the first component 8 which has the inlet channel or channels 2, so as to form the desired sealed hollow structures of the swirl nozzle 1.

The components 8, 9 are joined together, in particular, by so-called bonding or welding. However, theoretically any other suitable method of attachment or a sandwich construction is possible.

In a particularly preferred alternative embodiment, a plate member (not shown), particularly a silicon wafer is used, from which a plurality of first components 8 are used for a plurality of swirl nozzles 1. Before being broken down into individual components 8 or swirl nozzles 1, preferably the structures, especially depressions or recesses, are initially produced starting from a flat side of the plate member for the plurality of first components 8 or swirl nozzles 1. In particular, this is done by a treatment or etching of fine structures as is conventional in semiconductor manufacture, and consequently reference is hereby made in this respect to the prior art relating to the etching of silicon or the like.

Particularly preferably, the second component 9, like the first component 8, is made from a plate member which is broken down or separated into a plurality of second components 9. To produce the first components 8, it is particularly preferable to use a silicon wafer as the plate member, as explained above. The plate member used to produce the second components 9 may also be a silicon wafer or some other kind of wafer, a sheet of glass or the like.

If a plate member is used to produce both the first components 8 and the second components 9, it is particularly preferable to join the plate members together before they are broken down into the individual components 8, 9. This makes assembly and positioning substantially easier.

In order to assist with the positioning of the plate members relative to one another, it is particularly preferable to use plate members of the same size and shape. For example, if a disc-shaped silicon wafer is used to form the first components 8, it is recommended to use a disc-shaped plate member of the same size, e.g., made of glass, to form the second components 9. Obviously, other plate shapes may be used and joined together, such as rectangular plate members, for example. Circular discs are particularly recommended, however, as wafers of silicon or other materials are obtainable particularly cheaply. It should be noted that the plate members which are joined together may, if required, be of different shapes or sizes.

After the two components 8, 9 or the plate members which form them have been joined together, either before or after the separation or breaking down of the plate members into the individual components 8, 9 or into the swirl nozzles 1, the first component 8 or the corresponding plate member is machined, particularly ground away on the flat side remote from the second component 9 or the plate member thereof. In this way, the thickness of the first component 8 is substantially reduced. For a conventional silicon wafer, the initial thickness D1 is usually about 600 to 700 μm. This thickness D1 is substantially reduced, for example, to a thickness D2 of about 150 μm or less. This results in the opening up of the outlet channels 3, which were initially closed on one side, from the machining side. The length of the outlet channels 3 is thus determined by the thickness D2 to which the first component 8 or the plate member forming the components 8 is machined.

The method of manufacture described above makes it easy to produce the first component 8 very thinly and at the same time achieve very high stability and resistance for the swirl nozzle 1, particularly to high fluid pressures, as the second component 9 forms a unified whole with the first component 8 and ensures the required stability or stabilization of the first component 8, even when it is very thin.

Moreover, the fact that there is preferably no vortex chamber between the inlet channels 2 and the outlet channel 3 also contributes to the high stability or load-bearing capacity of the first component 8, even when it has a very low thickness D2. Instead, the elevated sections 4 or other webs or the like which delimit or define the inlet channels 2 may extend directly to the outlet channel 3, which has a substantially smaller diameter than a normal vortex chamber. Accordingly, the section of the first component 8 which is unsupported in this region is essentially reduced to the diameter of the outlet channel 3.

The plate members joined together are finally broken down into the preferably rectangular or square or optionally round components 8, 9, respectively, i.e., into the finished swirl nozzles, particularly by sawing or other machining.

Figure 3:
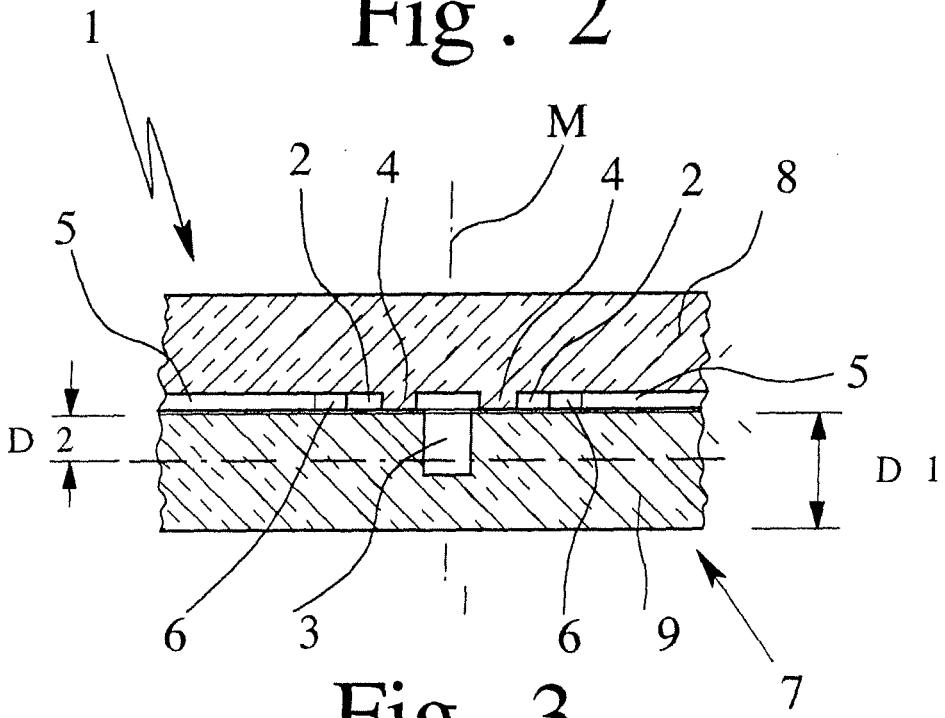
FIG. 3 is a schematic section through a second embodiment of a swirl nozzle in accordance with the invention taken along line III-III in FIG. 1.

A second embodiment of the proposed swirl nozzle 1 and a second embodiment of the preferred method of production will now be described with reference to FIG. 3. FIG. 3 shows, in a section taken along line III-III in FIG. 1, corresponding to FIG. 2, the swirl nozzle 1 according to the second embodiment. Only major differences between the second embodiment and the first embodiment will be described hereinafter. In other respects the foregoing remarks continue to apply accordingly or in supplementary manner.

In the second embodiment, the outlet channel 3 is formed at least partially, particularly at least essentially, in the second component 9. The remainder of the structure of the swirl nozzle 1, particularly at least one inlet channel 2, is formed in the first component 8. Consequently, it is possible to produce the outlet channel 3 at least largely independently of the manufacture of the remaining structure of the swirl nozzle 1, particularly the inlet region of the swirl nozzle 1.

In the second embodiment, before the two components 8, 9 are joined together, the outlet channel 3 is at least partly recessed in the second component 9, starting from a flat side and extending in particular at right-angles to the flat side, in the form of a recess, preferably by etching. However, it is theoretically also possible to form or recess the outlet channel 3 only after the two components 8, 9 have been joined together.

Particularly preferably, the outlet channel 3 is recessed initially only on one side, particularly by etching, in the second component 9 while it is open, before the two components 8 and 9 are joined together, i.e. as a blind bore as in the first embodiment, but in this case in the second component 9 and not in the first component 8.

Optionally, the surfaces can then be ground, polished or otherwise thinned, e.g. by spin etching. Then the two components 8 and 9 are joined together. Preferably, once again, this is done by joining together the plate members, each of which forms a plurality of components 8 or 9.

Finally, the second component 9 or the plate member forming the second components 9 is then thinned, particularly ground, on the flat side remote from the first component 8. This causes the outlet channel 3 or outlet channels 3 to be opened up from the machining side. The machining and/or opening may, however, also be carried out before the components are joined together.

The thinning of the second component 9 or of the corresponding plate member is preferably done to a thickness D2 as explained in the first embodiment, with the result that the remarks made previously apply here.

In the second embodiment, silicon is preferably used for the second component 9 as well. In particular, a silicon wafer or the like is used as a plate member for forming the second components 9.

The proposed manufacturing methods described are not restricted to the manufacture of the swirl nozzle 1 proposed or shown but may also be used generally for other swirl nozzles 1 and also for vortex chamber nozzles, i.e., swirl nozzles with vortex chambers.

During manufacture, etching is preferably used to work on the material, particularly to thin it. In this way, very precise, very fine structures can be obtained, particularly recesses, channels and the like, most preferably in the μm range of 50 μm, particularly 30 μm or less. However, in addition or alternatively, other methods of machining material and/or shaping, such as laser treatment, mechanical treatment, casting and/or embossing may also be used.

Preferably, the swirl nozzle 1 is at least substantially flat and/or plate-shaped. The main direction of flow or the main supply direction of the liquid (not shown) runs essentially in the main direction of extent, corresponding in particular to the planes of the plates of the components 8, 9 or the joined-together surfaces of the components 8, 9 or a plane parallel thereto. The outlet channel 3 preferably extends transversely, especially perpendicularly, to the main plane of extent or plane of the plate of the spray nozzle 1, to the main inflow direction of the liquid and/or to the main extent of the filter structure. The main direction of extent of the outlet channel 3 and the main direction of delivery of the swirl nozzle 1 preferably extend in the direction of the central axis M.

The inlet channels 2, the supply channel 6, the filter structure and/or other inflow regions for the liquid formed in the swirl nozzle 1 are preferably at least substantially arranged in a common plane and most preferably are formed only on one side, in particular, starting from a flat side or surface of the component 8.

Figure 4:
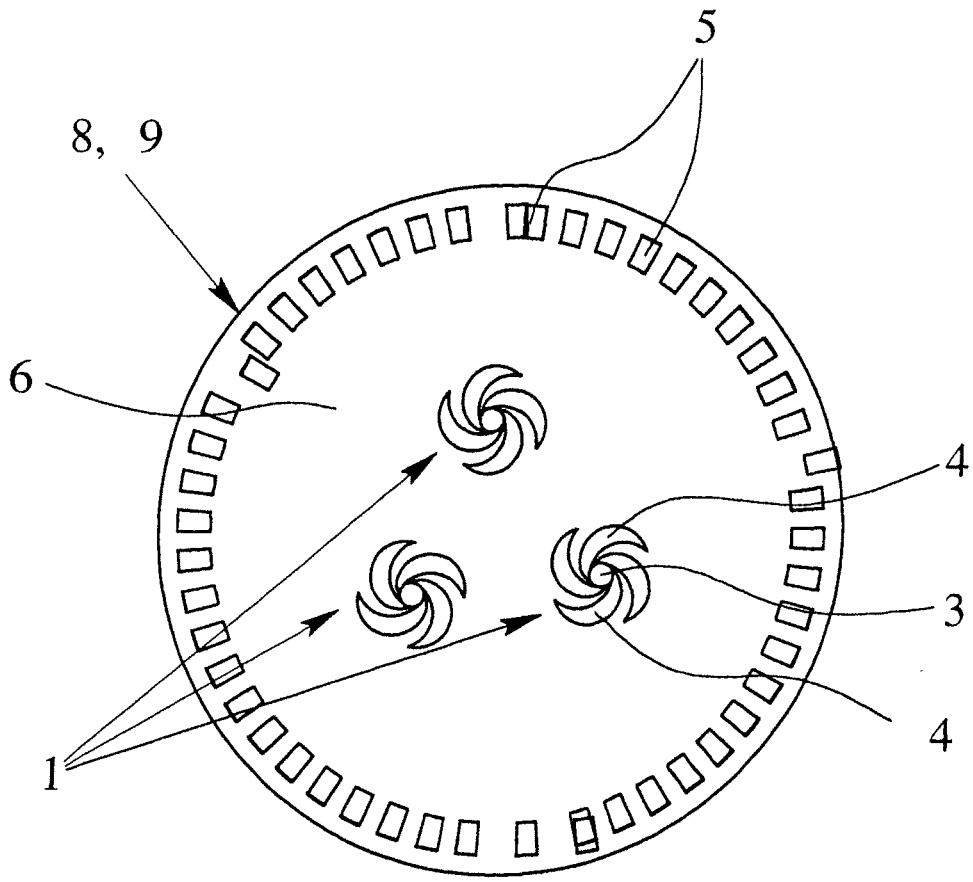
FIG. 4 is a schematic view of a proposed swirl nozzle arrangement according to a third embodiment of the invention.

Theoretically, a plurality of outlet channels 3 or even a plurality of swirl nozzles 1 may be formed on a component 8, 9. The structures are then adapted accordingly. FIG. 4 shows, in a view corresponding to FIG. 1, a swirl nozzle arrangement according to a third embodiment having several, in this case three, swirl nozzles 1 and a common filter structure 5 on a component 8 and/or 9. The foregoing remarks and explanations apply accordingly or in supplementary manner.

Individual features and aspects of the various embodiments may also be combined with one another as desired.

The proposed swirl nozzle 1 is most preferably used to atomize a liquid medicament formulation, the medicament formulation being passed through the swirl nozzle 1 under high pressure, so that the medicament formulation emerging from the outlet channel 3 is atomized into an aerosol (not shown), more particularly having particles or droplets with a mean diameter of less than 10 μm, preferably 1 to 7 μm, particularly substantially 5 μm or less.

Preferably, the proposed swirl nozzle 1 is used in an atomizer 10 which will be described hereinafter. In particular, the swirl nozzle 1 serves to achieve very good or fine atomizing while at the same time achieving a relatively large flow volume and/or at relatively low pressure.

Figure 5:
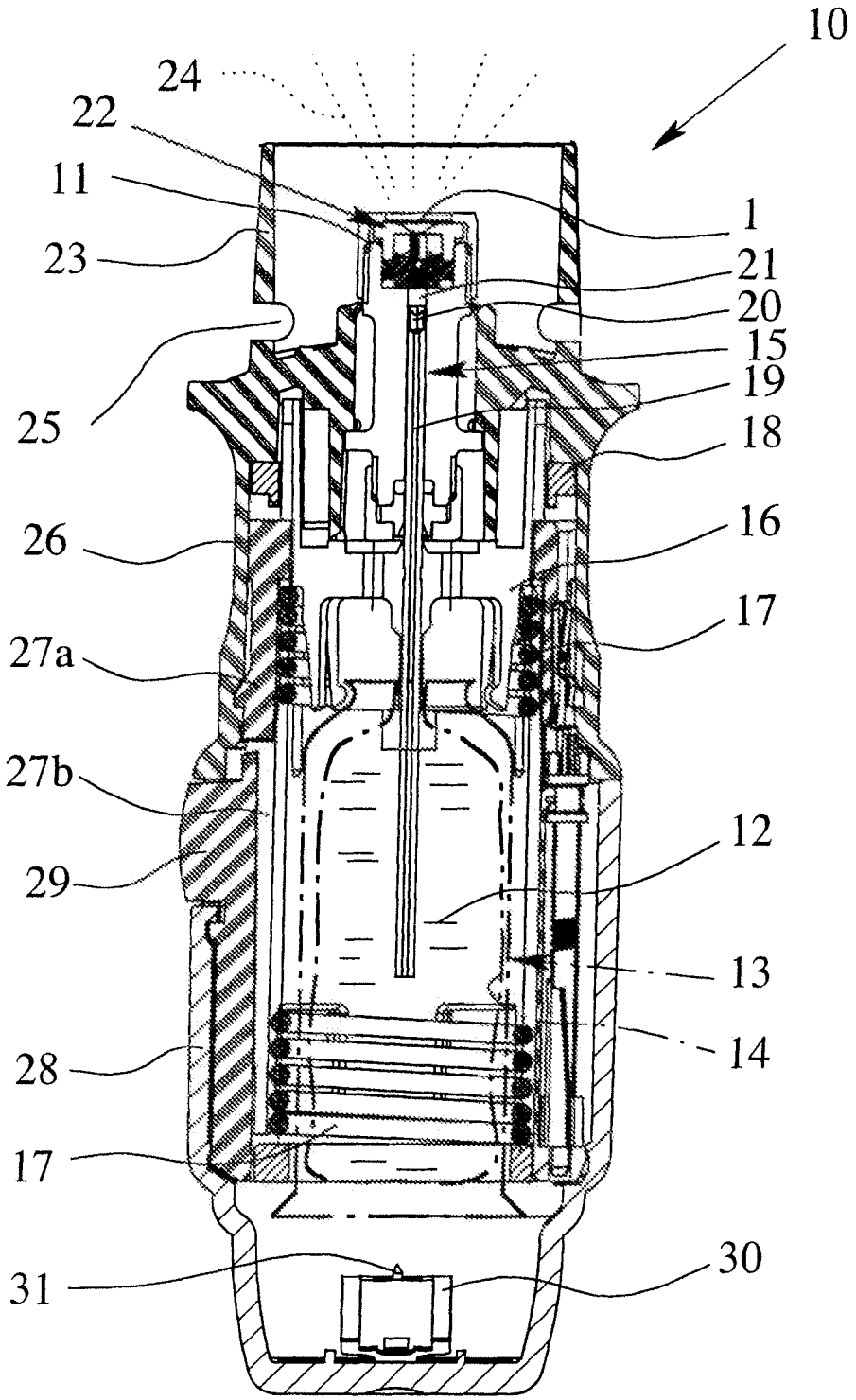
FIG. 5 is a schematic section through an atomizer in the non-tensioned stated with the proposed swirl nozzle.
Figure 6:
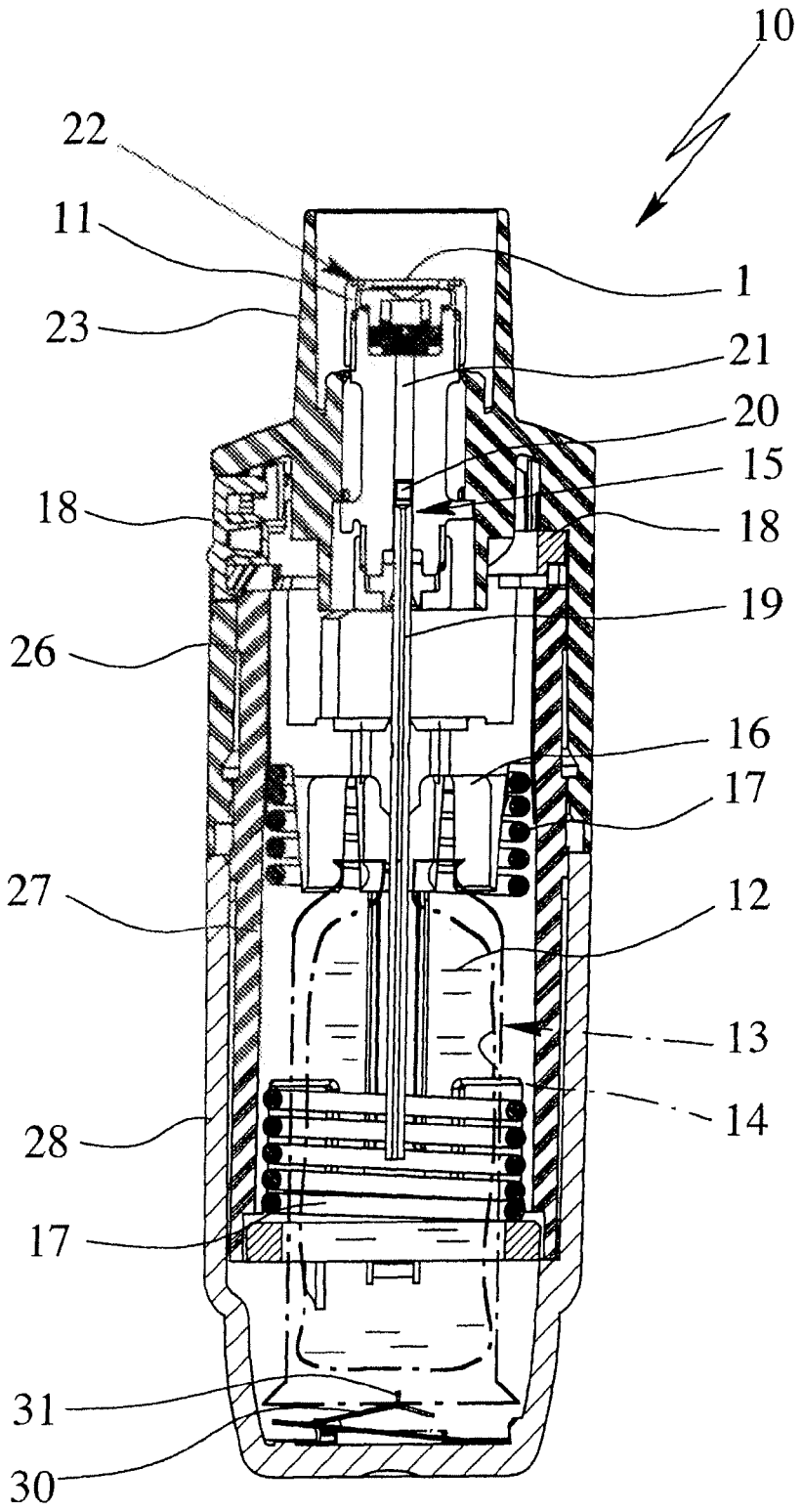
FIG. 6 is a schematic section through the atomizer in the tensioned state, rotated through 90° compared with FIG. 5.

FIGS. 5 & 6 show a diagrammatic view of the atomizer 10 in the relaxed state (FIG. 5) and in the tensioned state (FIG. 6). The atomizer 10 is constructed, in particular, as a portable inhaler and preferably operates without propellant gas.

The swirl nozzle 1 is preferably installed in the atomizer 10, particularly a holder 11. Thus, a nozzle arrangement 22 is obtained.

The atomizer 10 is used to atomize a fluid 12, particularly a highly effective medicament, a medicament formulation or the like. When the fluid 2, which is preferably a liquid, especially a medicament, is atomized, an aerosol 24 is formed which can be breathed in or inhaled by a user (not shown). Normally, the inhalation is carried out at least once a day, more particularly several times a day, preferably at prescribed intervals, depending on the patient's condition.

The atomizer 10 has an insertable and preferably replaceable container 13 containing the fluid 12. The container 13 thus constitutes a reservoir for the fluid 2 which is to be atomized. Preferably, the container 13 contains a sufficient quantity of fluid 12 or active substance to be able to provide up to 300 dosage units, for example, up to 300 sprays or applications.

The container 13 is substantially cylindrical or cartridge-like and can be inserted in the atomizer 10 from below, after the atomizer has been opened, and can optionally be replaced. The container is of rigid construction, the fluid 12 preferably being held in a fluid chamber 14 in the container 13, consisting of a collapsible bag.

The atomizer 10 also comprises a conveying device, preferably a pressure generator 15 for conveying and atomizing the fluid 12, particularly in a predetermined, optionally adjustable metered dosage.

The atomizer 10 or pressure generator 15 has a holding device 16 for the container 13, an associated drive spring 17, which is shown only in part, having a locking element 18 which can be manually operated to release it, a conveying tube 19 preferably in the form of a thick-walled capillary with an optional valve, particularly a non-return valve 20, a pressure chamber 21 and the nozzle arrangement 22 in the region of a mouthpiece 23. The container 13 is fixed in the atomizer 10 by means of the holding device 16, more particularly by engagement, such that the conveying tube 19 is immersed in the container 13. The holding device 16 may be constructed so that the container 13 can be released and replaced.

During the axial tensioning of the drive spring 17 the holding device 16 is moved downwards in the drawings together with the container 13 and conveying tube 19, and fluid 12 is sucked out of the container 13 through the non-return valve 20 into the pressure chamber 21 of the pressure generator 15.

During the subsequent release after actuation of the locking element 18, the fluid 12 in the pressure chamber 21 is put under pressure, by moving the conveying tube 19 with its now closed non-return valve 20 upwards again by releasing the drive spring 17 and it now acts as a pressure ram or piston. This pressure forces the fluid 12 out through the nozzle 22, where it is atomized into an aerosol 24, as shown in FIG. 10.

A user or patient (not shown) can inhale the aerosol 24, while a supply of air can preferably be sucked into the mouthpiece 23 through at least one air inlet opening 25.

The atomizer 10 has an upper housing part 26 and an inner part 27 which is rotatable relative to it (FIG. 6), having an upper part 27*a* and a lower part 27*b* (FIG. 5), while a housing part 28 which is, in particular, manually operated is releasably attached, preferably pushed onto, the inner part 27, preferably by means of a holding element 29. For inserting and/or exchanging the container 13 the housing part 28 can be detached from the atomizer 10.

The housing part 28 can be rotated relative to the upper housing part 26, carrying with it the lower part 27*b* of the inner part 27 which is lower down in the drawing. As a result the drive spring 17 is tensioned in the axial direction by means of a gear (not shown) acting on the holding device 16. During tensioning the container 13 is moved axially downwards until the container 13 assumes an end position as shown in FIG. 12. In this state the drive spring 17 is under tension. When the tensioning is carried out for the first time, an axially acting spring 30 disposed in the housing part 28 comes to abut on the base of the container and by means of a piercing element 31 pierces the container 13 or a seal at the bottom when it first comes into abutment therewith, for venting. During the atomizing process the container 13 is moved back into its original position shown in FIG. 5 by the drive spring 17, while the conveying tube 19 is moved into the pressure chamber 21. The container 13 and the conveying element or conveying tube 19 thus execute a lifting movement during the tensioning process or for drawing up the fluid and during the atomizing process.

It should be mentioned in general that, in the proposed atomizer 10, the container 13 can preferably be inserted into the atomizer 10, i.e., can be installed therein. Consequently, the container 13 is preferably a separate component. However, the container 13 or fluid chamber 14 may theoretically also be formed directly by the atomizer 10 or part of the atomizer 10 or in some other way integrated in the atomizer 10 or may be connectable thereto.

By contrast with free-standing equipment or the like, the proposed atomizer 10 is preferably constructed to be portable and/or manually operated, and in particular, it is a movable hand-held device.

It is particularly preferable for atomization to take place on each actuation for a period of about 1 to 2 breaths. However, theoretically, it is also possible for the atomization to be longer-lasting or continuous.

Particularly preferably, the atomizer 10 is constructed as an inhaler, especially for medicinal aerosol treatment. Alternatively, however, the atomizer 10 may also be designed for other purposes, and may preferably be used to atomize a cosmetic liquid and particularly as a perfume atomizer. The container 13 accordingly contains, for example, a medicament formulation or a cosmetic liquid such as perfume or the like.

Examples of atomizers of the type in which the swirl nozzle of the present application is usable can be found in commonly-owned U.S. Patent Application Publication Nos. 2007/0029475 and 2006/0027233, among others.

However, the proposed solution may be used not only in the atomizer 10 specifically described here but also in other atomizers or inhalers, e.g., powder inhalers or so-called metered dose inhalers.

The atomizing of the fluid 12 through the swirl nozzle 1 is preferably carried out at a pressure of about 0.1 to 35 MPa, in particular, about 0.5 to 20 MPa, and/or with a flow volume of about 1 to 300 μl/s, in particular about 5 to 50 μl/s.

What is claimed is:

1. Swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open into the outlet channel at least one of directly, radially and tangentially, wherein the inlet channels are formed between pairs of elevated sections that are at least substantially crescent-shaped, having a first tapered end adjacent the periphery of the outlet opening and an opposite, second tapered end disposed at a distance from the periphery of the outlet opening, the elevated sections of each pair forming the inlet channels therebetween in a partial spiral shape; wherein supply channels are provided at locations disposed radially outward of the inlet channels, the supply channels being directed radially toward the outlet channel; and wherein the supply channels, the inlet channels and an inner end of the outlet channel are all disposed in a common plane, and wherein the inlets of the inlet channels are at a spacing of 50 to 300 μm from a central axis of the outlet channel.

2. Swirl nozzle according to claim 1, wherein from two to twelve inlet channels open into the outlet channel and extend in said common plane.

3. Swirl nozzle according to claim 1, wherein the inlet channels are each provided with a curvature that is constant or that increases continuously towards the outlet channel.

4. Swirl nozzle according to claim 1, wherein the inlet channels each taper towards the outlet channel.

5. Swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open into the outlet channel at least one of directly, radially and tangentially, wherein the inlet channels are formed between pairs of elevated sections that are at least substantially crescent-shaped, having a first tapered end adjacent the periphery of the outlet opening and an opposite, second tapered end disposed at a distance from the periphery of the outlet opening, the elevated sections of each pair forming the inlet channels therebetween in a partial spiral shape; wherein supply channels are provided at locations disposed radially outward of the inlet channels, the supply channels being directed radially toward the outlet channel; and wherein the supply channels, the inlet channels and an inner end of the outlet channel are all disposed in a common plane, and wherein the inlet channels each have an outlet depth of 5 to 35 μm.

6. Swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open into the outlet channel at least one of directly, radially and tangentially, wherein the inlet channels are formed between pairs of elevated sections that are at least substantially crescent-shaped, having a first tapered end adjacent the periphery of the outlet opening and an opposite, second tapered end disposed at a distance from the periphery of the outlet opening, the elevated sections of each pair forming the inlet channels therebetween in a partial spiral shape; wherein supply channels are provided at locations disposed radially outward of the inlet channels, the supply channels being directed radially toward the outlet channel; and wherein the supply channels, the inlet channels and an inner end of the outlet channel are all disposed in a common plane, and wherein the inlet channels each have an outlet width of 2 to 30 μm.

7. Swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open into the outlet channel at least one of directly, radially and tangentially, wherein the inlet channels are formed between pairs of elevated sections that are at least substantially crescent-shaped, having a first tapered end adjacent the periphery of the outlet opening and an opposite, second tapered end disposed at a distance from the periphery of the outlet opening, the elevated sections of each pair forming the inlet channels therebetween in a partial spiral shape; wherein supply channels are provided at locations disposed radially outward of the inlet channels, the supply channels being directed radially toward the outlet channel; and wherein the supply channels, the inlet channels and an inner end of the outlet channel are all disposed in a common plane, and wherein the length of the outlet channel corresponds to 0.5 to 2 times the diameter of the outlet channel.

8. Swirl nozzle according to claim 7, wherein the outlet channel has at least one of an at least substantially cylindrical form and an at least substantially constant cross section.

9. Swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open into the outlet channel at least one of directly, radially and tangentially, wherein the inlet channels are formed between pairs of elevated sections that are at least substantially crescent-shaped, having a first tapered end adjacent the periphery of the outlet opening and an opposite, second tapered end disposed at a distance from the periphery of the outlet opening, the elevated sections of each pair forming the inlet channels therebetween in a partial spiral shape; wherein supply channels are provided at locations disposed radially outward of the inlet channels, the supply channels being directed radially toward the outlet channel; and wherein the supply channels, the inlet channels and an inner end of the outlet channel are all disposed in a common plane, and the inlet channels extending transversely to the outlet channel, wherein the swirl nozzle comprises a filter structure located upstream of the inlet channels, the filter structure having passages with a smaller cross section than that of the inlet channels, the number of passages of the filter structure being greater than the number of inlet channels so that the flow resistance of the filter structure is less than the flow resistance of the inlet channels.

10. Swirl nozzle according to claim 9, wherein the inlet channels are connected at least one of at their inlet end to a common supply channel and at their outlet end directly to the outlet channel.

11. Swirl nozzle according to claim 10, wherein the supply channel is arranged between the filter structure and the inlet channels.

12. Swirl nozzle according to claim 9, wherein both the inlet channels and at least one of the filter structure and the supply channel are located in said common plane.

13. Swirl nozzle according to claim 1 or 9, wherein the swirl nozzle is at least substantially flat or plate-shaped in construction, while the delivery channel extends transversely to a main plane of the swirl nozzle.

14. Swirl nozzle according to claim 1 or 9, wherein the fluid can be supplied to the outlet channel exclusively through the inlet channels.

15. Swirl nozzle according to claim 10, wherein at least two of the inlet channels, the outlet channel, the common supply channel and the filter structure are formed in a nozzle body.

16. Atomizer according to claim 9, wherein the passages of the filter are radially directed and are defined by straight sidewalls of constant spacing while the inlet channels are defined by the curved side walls that have a spacing that gets smaller in a direction toward the outlet channel.

17. Atomizer for atomizing a medicament formulation, having a swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open into the outlet channel at least one of directly, radially and tangentially, wherein the inlet channels are formed between pairs of elevated sections that are at least substantially crescent-shaped, having a first tapered end adjacent the periphery of the outlet opening and an opposite, second tapered end disposed at a distance from the periphery of the outlet opening, the elevated sections of each pair forming the inlet channels therebetween in a partial spiral shape; wherein supply channels are provided at locations disposed radially outward of the inlet channels, the supply channels being directed radially toward the outlet channel; and wherein the supply channels, the inlet channels and an inner end of the outlet channel are all disposed in a common plane; wherein the swirl nozzle comprises a filter structure located upstream of the inlet channels, the filter structure having passages with a smaller cross section than that of the inlet channels, the number of passages of the filter structure being greater than the number of inlet channels so that the flow resistance of the filter structure is less than the flow resistance of the inlet channels.

18. Atomizer according to claim 17, wherein the atomizer is of a size rendering it portable and is adapted to be manually operated.

19. Atomizer according to claim 17, wherein the atomizer comprises a reservoir, containing a fluid to be atomized.

20. Atomizer according to claim 17, wherein the atomizer is of a size rendering it portable and is adapted to be manually operated.

21. Atomizer according to claim 17, wherein the atomizer comprises a reservoir, containing a fluid to be atomized.

22. Atomizer for atomizing a medicament formulation, having a swirl nozzle for delivering and atomizing at least one of a medicament formulation, a cosmetic agent, an agent for body or beauty care, a cleaning agent and household agent fluid, the swirl nozzle having inlet channels and an outlet channel, the inlet channels extending transversely to the outlet channel, wherein the inlet channels open directly into the outlet channel, wherein the inlet channels are formed between pairs of elevated sections that are at least substantially crescent-shaped with a convex curvature on a first side of the elevated sections that defines a first side of the inlet channels and a concave curvature on an opposite second side of the elevated sections that defines an opposite second side of the inlet channels, the first and second sides of the elevated sections meeting at opposite tapered ends~a first of the tapered ends being tangentially adjacent the periphery of the outlet opening and an opposite, second tapered end disposed at a distance from the periphery of the outlet opening, the elevated sections of each pair forming the inlet channels therebetween in a partial spirally curved shape that tapers to an outlet end therof; wherein supply channels are provided at locations disposed radially outward of the inlet channels, the supply channels being directed radially toward the outlet channel; and wherein the supply channels, the inlet channels and an inner end of the outlet channel are all disposed in a common plane wherein the curved shape of the inlet channels are curved at least substantially according to the following formula, which gives the shape of the sidewalls of the inlet channels in polar coordinates (r=radius, W=angle):

$$r = R_E\left(\frac{R_A}{R_E}\right)^{\frac{W-W_E}{W_A-W_E}},$$

wherein $R_A$ is the outlet radius and $R_E$ is the inlet radius the inlet channel and $W_A$ and $W_E$ are the corresponding angles.

* * * * *